US006339284B1

(12) United States Patent
Takekawa et al.

(10) Patent No.: US 6,339,284 B1
(45) Date of Patent: Jan. 15, 2002

(54) COLOR CATHODE RAY TUBE APPARATUS HAVING AUXILIARY GRID ELECTRODES

(75) Inventors: Tsutomu Takekawa; Hirofumi Ueno, both of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/360,457

(22) Filed: Jul. 26, 1999

(30) Foreign Application Priority Data

Jul. 27, 1998 (JP) ..... 10-210892

(51) Int. Cl.[7] ..... H01J 29/50; H01J 29/58; H01J 29/56; H01J 29/46; G09G 1/04

(52) U.S. Cl. ..... 313/414; 313/449; 315/382; 315/15

(58) Field of Search ..... 313/409, 412, 313/414, 441, 444, 446, 449, 452, 447, 453; 315/15, 364, 382, 383

(56) References Cited

U.S. PATENT DOCUMENTS 4,319,163 A 3/1982 Chen ..... 313/414
5,061,881 A * 10/1991 Suzuki et al. ..... 313/414
5,864,203 A * 1/1999 Yamane ..... 313/414

FOREIGN PATENT DOCUMENTS

JP 10-214574 8/1998

* cited by examiner

*Primary Examiner*—Ashok Patel
*Assistant Examiner*—Mariceli Santiago
(74) *Attorney, Agent, or Firm*—Oblon, Spivak, McClelland, Maier & Neustadt, P.C.

(57) ABSTRACT

In a self-convergent type color cathode ray tube apparatus, three in-line electron beams emitted from an electron gun assembly are deflected by non-uniform magnetic fields generated by a deflection yoke and thus self-converged onto a screen. The electron gun assembly has a second grid and a third grid. First and second auxiliary grids are disposed between the second and third grids. A dynamic voltage varying in synchronism with deflection of the electron beams is applied to the first auxiliary grid situated on the second grid side. A fixed voltage is applied to the second auxiliary grid situated on the third grid side. Accordingly, the second grid, the first and second auxiliary grids and the third grid form an electron lens such that a higher astigmatism is provided by focusing in a direction perpendicular to a direction of arrangement of the three electron beams than by focusing in the direction of arrangement of the three electron beams and the degree of the astigmatism is dynamically varied. A color cathode ray tube apparatus capable of performing uniform focusing over the entire screen with a relatively low dynamic voltage is provided.

9 Claims, 5 Drawing Sheets

COLOR CATHODE RAY TUBE APPARATUS HAVING AUXILIARY GRID ELECTRODES

BACKGROUND OF THE INVENTION

The present invention relates generally to a color cathode ray apparatus, and more particularly to a color cathode ray tube apparatus wherein an elliptic distortion of a beam spot at a peripheral portion of a screen is reduced and thereby an image with high quality is displayed.

In general, a color cathode ray tube (CRT) apparatus has a vacuum envelope comprising a panel and a funnel. Three electron beams are emitted from an electron gun assembly disposed in a neck of the funnel. The three electron beams are deflected by horizontal and vertical deflection magnetic fields generated by is a deflection yoke. The deflected beams are then guided through a shadow mask onto a phosphor screen provided on an inner surface of the panel. The phosphor screen is scanned horizontally and vertically by the three electron beams, and thus a color image is displayed on the phosphor screen.

A self-convergence in-line type color cathode ray tube in which an in-line type electron gun assembly is built, in particular, has widely been used as the above color CRT apparatus. In the in-line type electron gun assembly, electron guns are horizontally arranged to emit three in-line electron beams consisting of a center beam and a pair of side beams in the same horizontal plane. In the self-convergence type color CRT, its deflection yoke generates non-uniform magnetic fields, i.e. a pin-cushion-shaped horizontal deflection magnetic field and a barrel-shaped vertical deflection magnetic field, and the in-line three electron beams self-converge on the screen.

Electron gun assemblies for emitting three in-line electron beams may have various structures. There is known an electron gun assembly of a bipotential (BPF) type DACF (Dynamic Astigmatism Correct and Focus) system. The electron gun assembly of the BPF type DAF system, as shown in FIG. 1, comprises three in-line cathodes K and first to fourth grids G1 to G4 arranged in the named order from the cathode K side toward a phosphor screen. The third grid G3 is comprised of two divisional segment electrodes G31 and G32. The grids G1, G2, G31, G32 and G4 are integrally constructed such that each has three in-line electron beam passage holes for passing electron beams and the positions of these holes correspond in position to three cathodes K.

In this electron gun assembly, a voltage of about 150V is applied to each cathode K. The first grid G1 is grounded, and a voltage of about 600 to 800V is applied to the second grid G2. A voltage of about 6 kV is applied to the first segment electrode G31 of the third grid G3. The second segment electrode G32 is supplied with a dynamic voltage increasing in synchronism with deflection of an electron beam by the deflection yoke, which dynamic voltage being added to a reference voltage applied to the first segment electrode G31. A high voltage of about 26 kV is applied to the fourth grid G4.

In the electron gun assembly, with the application of such voltages, the cathodes K and first and second grids G1 and G2 generate electron beams and constitute a three-pole (triple-pole) unit for forming an object point on a main lens (described below). The second grid G2 and the first segment electrode G31 of the third grid G3 constitute a prefocus lens for preliminarily focusing the electron beams from the triple-pole unit. The first and second segment electrodes G31 and G32 constitute a quadruple-pole lens for horizontally focusing and vertically diverging electron beams when they are deflected. The second segment electrode G32 and fourth grid G4 constitute a high-potential (BPF) type main lens for finally focusing the electron beams on the phosphor screen.

In this electron gun assembly, when the electron beams are directed to the center of the screen without deflection, the quadruple-pole lens is not formed between the first and second segment electrodes G31 and G32. The electron beams from the triple-pole unit are preliminarily focused by the prefocus lens and focused on the center of the screen of the main lens.

On the other hand, when the electron beams are deflected toward the periphery of the screen, the voltage of the second segment electrode G32 is increased in accordance with the amount of deflection of the electron beams and the quadruple-pole lens for horizontally focusing and vertically diverging electron beams is formed between the first and second segment electrodes G31 and G32. At the same time, with the increase in voltage of the second segment electrode G32, the power of the main lens formed at the second segment electrode G32 and fourth grid G4 is decreased. Thereby, when the electron beams are deflected toward the periphery of the screen, the electro-optical distance between the electron gun assembly and the phosphor screen increases and an image point will form at a long distance. Accordingly, the magnification of the lens varies to cancel a deflection aberration occurring due to the fact that the horizontal deflection field generated by the deflection yoke has a pin-cushion shape and the vertical deflection field has a barrel-shape.

In the meantime, in order to enhance the image quality of the color CRT, it is necessary to enhance the focusing characteristics of the entire screen. However, in an in-line type color CRT having a regular electron gun assembly for emitting three in-line electron beams, as shown in FIG. 2A, a beam spot at a peripheral portion of the screen is distorted to a horizontal elliptic shape 1*b* (horizontal deformation) due to a deflection aberration and a vertical blur 2 occurs, although a beam spot 1*b* at a central portion of the screen has a substantially circular shape.

On the other hand, in the in-line type color CRT having the electron gun assembly, as shown in FIG. 1, the blur 2 can be eliminated and the focusing characteristics can be enhanced, as shown in FIG. 2B. This electron gun assembly adopts the DACF system, and the low-voltage side electrode constituting the BPF type main lens is divided into a plurality of segment electrodes and these segment electrodes form the four-pole lens in accordance with the amount of deflection of electron beams, thereby to compensate the deflection aberration. Even in the electron gun assembly with this structure, however, the horizontal deformation of the beam spot 1*b* at the peripheral portion of the screen cannot be eliminated. As a result, a moire occurs due to an interference between the electron beams and the beam passage holes in the shadow mask, and displayed characters, etc. on the screen becomes difficult to view.

In a method of solving the above problem, in the above-described electron gun assembly, as shown in FIG. 3, non-circular electron beam passage holes 4, each having a horizontal long axis, are formed in that surface of the second grid G2, which face the first segment electrode G31 of third grid G3. In the electron gun assembly with this structure, the horizontal focusing power of the prefocus lens constituted by the second grid G2 and the first segment electrode G31 is weaker than the vertical focusing power thereof, and a horizontal imaginary object point size is reduced and a vertical imaginary object point size is increased. As a result, as shown in FIG. 2C, the beam spot la at the central portion of the screen is vertically elongated and the horizontal deformation of the beam spot 1*b* at the peripheral portion of the screen is reduced. Thus, the moiré due to an interference between the electron beams and the beam passage holes in the shadow mask can be prevented.

In this electron gun assembly, as the depth of the non-circular recess 4 with the horizontal long axis, which is formed in the second grid, increases, the horizontal deformation of the beam spot 1*b* at the peripheral portion of the screen can be reduced more effectively. As a result, however, the vertical length of the beam spot 11 at the central portion of the screen is increased and the vertical dimension of the beam spot increases. Consequently, the resolution at the central portion of the screen deteriorates.

As means for solving this problem, FIG. 3 shows an electron gun assembly wherein an auxiliary grid Gs having vertically or horizontally elongated non-circular electron beam passage holes is disposed between the second grid G2 and the first segment electrode G31 of the third grid G3. The auxiliary grid Gs is supplied with a dynamic voltage increasing or decreasing in synchronism with the deflection of electron beams.

With this structure, the horizontal focusing and vertical focusing of the prefocus lens formed by the second grid G2 and first segment electrode G31 can be dynamically altered. Thereby, when the electron beams are not deflected and are directed to the central area of the screen, the horizontal focusing of the prefocus lens is equalized to the vertical focusing. In addition, when the electron beams are deflected toward the periphery of the screen, the prefocus lens is provided with such an astigmatism that the horizontal focusing is weak and the vertical focusing is strong, and the horizontal imaginary object point size is reduced while the vertical imaginary object point size is increased. Thus, a color CRT displaying high-quality images can be provided wherein the vertical size of the beam spot at the peripheral portion of the screen is increased without degradation in resolution at the central portion of the screen, and the horizontal deformation at the peripheral portion of the screen is reduced and the focusing is made uniform over the entire area of the screen.

In actuality, however, in order to obtain a desired electron beam divergence angle and a desired imaginary object point size with the above electron gun assembly, a relatively high dynamic voltage of 1.5 to 3 kv needs to be applied to the auxiliary grid Gs. The reason is that the auxiliary grid Gs faces the first segment electrode G31 of third grid G3 to which a relatively high voltage of about 6 kV is applied and if the voltage to the auxiliary grid Gs is decreased, a shift of potential from the first segment electrode G31 to the auxiliary grid Gs becomes too great and the astigmatism of the prefocus lens becomes too strong.

As has been described above, in order to apply a relatively high dynamic voltage to the auxiliary grid Gs, a driver circuit for generating a relatively high dynamic voltage is required and the cost for circuit elements increases.

In order to enhance the image quality of the color CRT, it is necessary that the good focusing state be maintained over the entire screen and an elliptic distortion of the beam spot be decreased.

In this respect, with the conventional BPF-type DACF-system electron gun assembly, a dynamic voltage increasing in synchronism with deflection of electron beams is applied to the low-voltage-side electrode forming the BPF-type main lens, thereby forming a four-pole lens and varying the power of the main lens. Thus, a vertical blur of the beam spot at the peripheral portion of the screen due to the deflection aberration can be eliminated and the focusing characteristics enhanced. However, with this electron gun assembly, the horizontal deformation of the beam spot at the peripheral portion of the screen cannot be prevented, and a moiré occurs due to an interference between the electron beams and the beam passage holes in the shadow mask. Consequently, displayed characters, etc. on the screen become difficult to view.

In order to solve the problem of horizontal deformation of the beam spot at the peripheral portion of the screen, there has been proposed an electron gun assembly wherein non-circular recesses, each having a horizontal long axis, are formed in that surface of the second grid, which face the first segment electrode of the third grid. According to this electron gun assembly, the horizontal deformation of the beam spot at the peripheral portion of the screen is reduced and the moiré due to an interference between the electron beams and the beam passage holes in the shadow mask can be prevented. However, the beam spot at the central portion of the screen is vertically elongated. Moreover, as the depth of each non-circular recess with the horizontal long axis, which is formed in the second grid, increases, the horizontal deformation of the beam spot at the peripheral portion of the screen can be reduced more effectively, and the vertical length of the beam spot at the central portion of the screen is increased. Consequently, the resolution at the central portion of the screen deteriorates.

In other words, with this electron gun assembly, if importance is placed on the clearness of image at the central portion of the screen, the image quality at the peripheral portion of the screen will deteriorate. If importance is placed on the clearness of image at the peripheral portion of the screen, the image quality at the central portion of the screen will deteriorate. Consequently, in the color CRT having the electron gun assembly with the above structure, the focusing over the entire screen cannot be performed satisfactorily, and less desirable designing needs to be done.

In order to solve the above problem, there has been proposed an electron gun assembly wherein an auxiliary grid having vertically or horizontally elongated non-circular electron beam passage holes is disposed between the second grid and the first segment electrode of the third grid. This auxiliary grid is supplied with a dynamic voltage increasing or decreasing in synchronism with the deflection of electron beams.

With this structure, a color CRT displaying high-quality images can be provided wherein the vertical size of the beam spot at the peripheral portion of the screen is increased without degradation in resolution at the central portion of the screen, and the horizontal deformation at the peripheral portion of the screen is reduced and the focusing is made uniform over the entire area of the screen. With this electron gun assembly, however, a relatively high dynamic voltage of 1.5 to 3 kV needs to be applied to the auxiliary grid, and the cost for the driver circuit increases.

BRIEF SUMMARY OF THE INVENTION

The object of the present invention is to provide a color CRT capable of performing uniform focusing over the entire screen with a relatively low dynamic voltage.

(1) A color cathode ray tube apparatus has an electron gun assembly for generating three in-line electron beams traveling in a single plane. The electron gun assembly has a plurality of electrodes including cathodes for generating the three electron beams and constituting a triple-pole unit, first and second grids disposed successively from the cathode side toward a phosphor screen side, and a third grid disposed adjacent to the second grid, the third grid forming a lens for focusing the electron beams from the triple-pole unit onto the phosphor screen. The three electron beams emitted from the electron gun assembly are deflected by non-uniform horizontal and vertical deflection magnetic fields generated by a deflection yoke and are self-converged. First and second auxiliary grids are disposed between the second grid and the third grid. A dynamic voltage, which varies in synchronism with deflection of the electron beams, is applied to the first auxiliary grid. A fixed voltage is applied to the second auxiliary grid. The second grid, first and second auxiliary grids and third grid form an electron lens such that a higher astigmatism is provided by focusing in a direction perpendicular to a direction of arrangement of the three electron beams than by focusing in the direction of arrangement of the three electron beams and the degree of the astigmatism is dynamically varied in accordance with the dynamic voltage applied to the first auxiliary grid.

(2) In the color cathode ray tube apparatus according to aspect (1), a dynamic voltage obtained by superimposing a voltage increasing in synchronism with the deflection of the electron beams to a voltage substantially equal to a voltage applied to the second grid is applied to the first auxiliary grid.

(3) In the color cathode ray tube apparatus according to aspect (1), a voltage equal to a voltage applied to the second grid is applied to the second auxiliary grid.

(4) In the color cathode ray tube apparatus according to aspect (1), the first auxiliary grid has electron beam passage holes for passage of the three electron beams, each of the electron beam passage holes being formed non-circular such that a dimension thereof in a direction perpendicular to a direction of arrangement of the three electron beams is greater than a dimension thereof in the direction of arrangement of the three electron beams.

(5) In the color cathode ray tube apparatus according to aspect (1), the second auxiliary grid has circular electron beam passage holes for passage of the three electron beams.

(6) In the color cathode ray tube apparatus according to aspect (1), the second auxiliary grid has electron beam passage holes for passage of the three electron beams, each of the electron beam passage holes being formed non-circular such that a dimension thereof in a direction perpendicular to a direction of arrangement of the three electron beams is different from a dimension thereof in the direction of arrangement of the three electron beams.

(7) In the color cathode ray tube apparatus according to aspect (1), that surface of the second grid, which faces the first auxiliary grid, has non-circular recesses each having a major axis in a direction of arrangement of the three electron beams or a groove elongated in the direction of arrangement of the three electron beams, independently of three beam passage holes formed in the second grid.

(8) In the color cathode ray tube apparatus according to aspect (1), the second grid has circular holes for passage of the three electron beams, the first auxiliary grid has holes for passage of the electron beams, each of which holes is formed non-circular such that a dimension thereof in a direction perpendicular to a direction of arrangement of the three electron beams is greater than a dimension thereof in the direction of arrangement of the three electron beams, and the second auxiliary grid has circular holes for passage of the electron beams. When a diameter of each of the holes in the second auxiliary grid is $\phi G2$, a dimension of each of the holes in the first auxiliary grid in the direction perpendicular to the direction of arrangement of the three electron beams is $\phi Gs1V$, a dimension of each of the holes in the first auxiliary grid in the direction of arrangement of the three electron beams is $\phi Gs1H$, and a diameter of each of the holes in the second auxiliary grid is $\phi Gs2$, the following relationship is established:

$$\phi G2 \leqq \phi Gs1H < \phi Gs2 \leqq \phi Gs1V.$$

(9) In the color cathode ray tube apparatus according to aspect (1), the third grid is divided into first and second electrodes, and a dynamic voltage varying in synchronism with deflection of the electron beams is applied to the second electrode disposed apart from the second auxiliary grid.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of a color cathode ray tube (CRT) apparatus according to the present invention will now be described with reference to the accompanying drawings.

Figure 4:
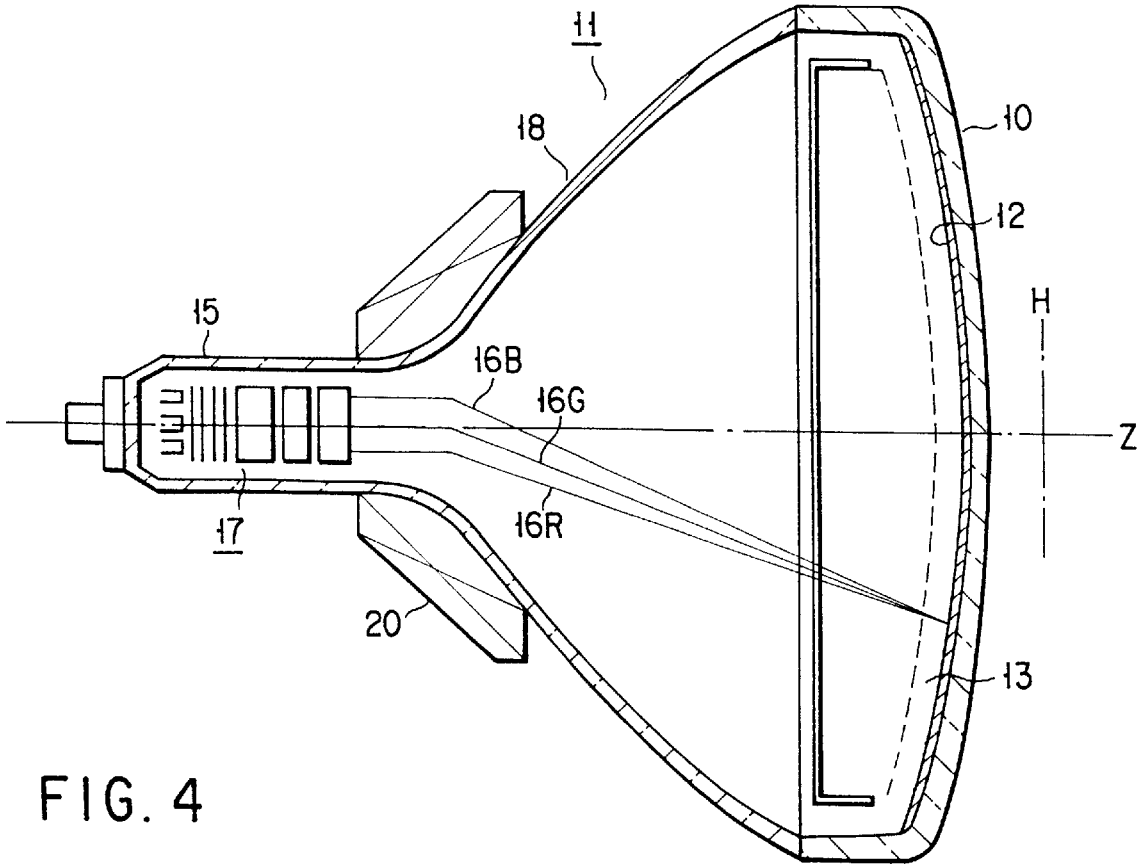
FIG. 4 schematically shows the structure of an in-line type color cathode ray tube (CRT) apparatus according to an embodiment of the present invention.

FIG. 4 shows an in-line type color CRT apparatus according to an embodiment of the invention. The color CRT apparatus has an envelope comprising a substantially rectangular panel 10 and a funnel 11. A phosphor screen 12 composed of a dot-like or stripe-like three-color phosphor layer for emitting blue, green and red is provided on an inner surface of the panel 10. A shadow mask 13 is disposed inside the phosphor screen 12 so as to face the phosphor screen 12. On the other hand, an electron gun assembly 17 (constructed as described below) for emitting three in-line electron beams 16B, 16G and 16R, i.e. a center beam 16G and a pair of side beams 16B and 16R traveling in the same horizontal plane, is disposed within a neck 15 of the funnel 11. A deflection yoke 20 for generating a non-uniform magnetic field comprising a pin-cushion-shaped horizontal flat magnetic field and a barrel-shape vertical deflection magnetic field is mounted on an outer boundary portion between a large-diameter portion 18 of the funnel 11 and the neck 15. The three electron beams 16B, 16G and 16R emitted from the electron gun assembly 17 are deflected by the horizontal and vertical magnetic fields generated by the deflection yoke 20 and guided to the phosphor screen 12 via the shadow mask 13. The phosphor screen 12 is horizontally and vertically scanned by the three electron beams 16B, 16G and 16R and thus a color image is displayed on the phosphor screen 12.

Figure 5:
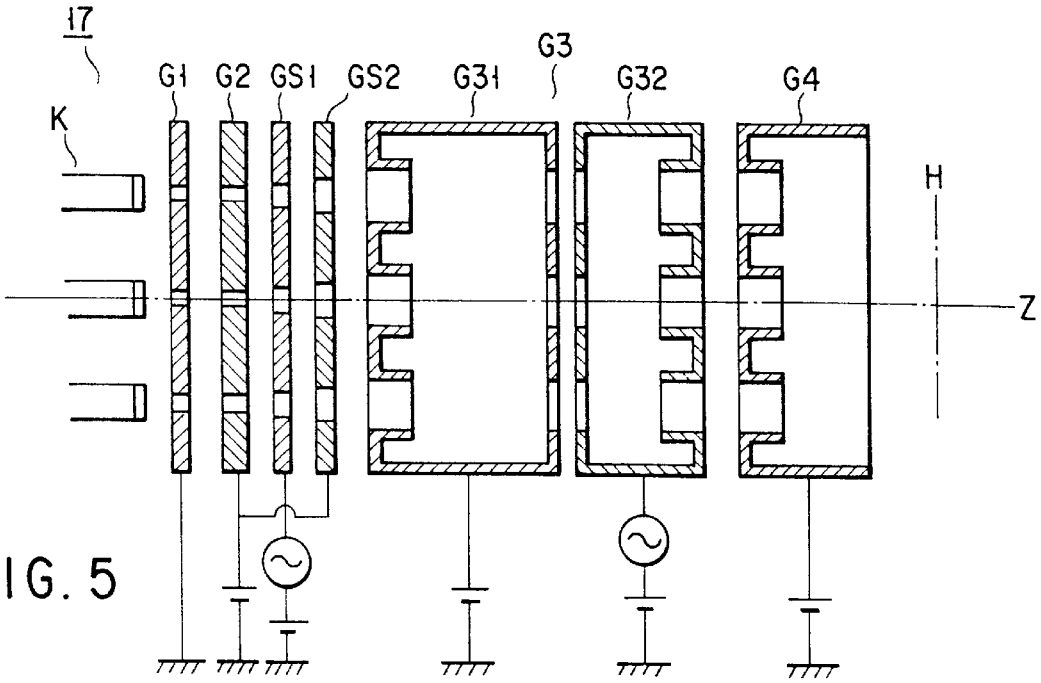
FIG. 5 is a cross-sectional view schematically showing the structure of an electron gun assembly of the color CRT apparatus shown in FIG. 4.

The electron gun assembly 17, as shown in FIG. 5, comprises three cathodes K horizontally arranged in line (in H-axis direction), three heaters (not shown) for individually heating the cathodes K, and first to fourth grids G1 to G4 successively arranged at predetermined intervals from the cathode (K) side toward the phosphor screen. The third grid G3 is divided into two segment electrodes G31 and G32 (first and second segment electrodes) arranged from the second grid (G2) side toward the fourth grid G4. In the electron gun assembly 17, two auxiliary grids Gs1 and Gs2 (first and second auxiliary grids) are arranged between the second grid G2 and the first segment electrode G31 of the third grid G3.

Each of the first and second grids G1 and G2 and first and second auxiliary grids Gs1 and Gs2 is formed of an integral plate electrode having a greater dimension in the direction of arrangement of the cathodes K. Each of the first and second segment electrodes G31 and G32 of third grid G3 is formed of an integral cylindrical electrode having a longer diameter in the direction of arrangement of the cathodes K. The fourth grid G4 is formed of an integral cup-shaped electrode having a longer diameter in the direction of arrangement of cathodes K.

Figure 6A:
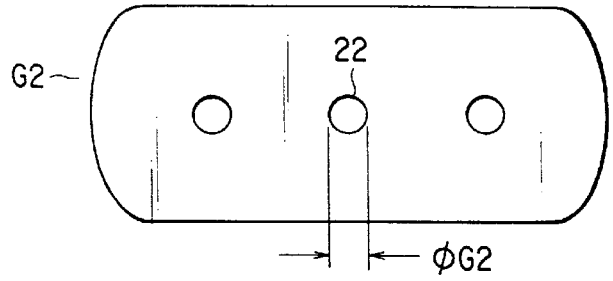
FIG. 6A is a plan view schematically showing the shape of each electron beam passage hole in the second grid of the electron gun assembly shown in FIG. 5.
Figure 6B:
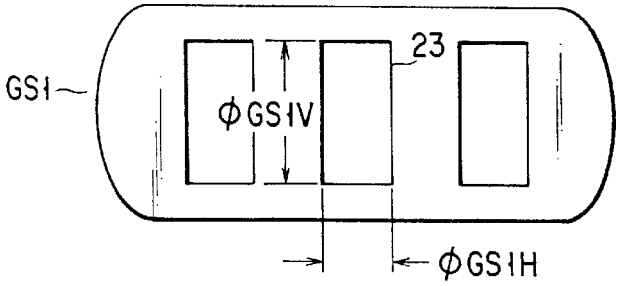
FIG. 6B is a plan view schematically showing the shape of each electron beam passage hole in the first auxiliary grid of the electron gun assembly shown in FIG. 5.
Figure 6C:
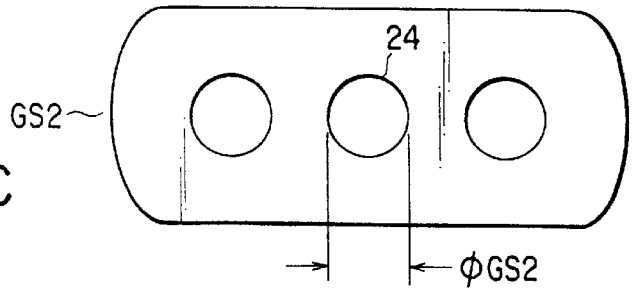
FIG. 6C is a plan view schematically showing the shape of each electron beam passage hole in the second auxiliary grid of the electron gun assembly shown in FIG. 5.

Each of the first and second grids G1 and G2 is provided with three circular electron beam passage holes 22 so arranged horizontally in line as to correspond to the three cathodes K. FIG. 6A shows the second grid G2 having three circular electron beam passage holes 22 arranged horizontally in line. FIG. 6B shows the first auxiliary grid Gs1 having three non-circular electron beam passage holes 23 arranged horizontally in line. Each hole 23 has a vertical dimension $\phi$Gs1V which is greater than a horizontal dimension $\phi$Gs1H thereof. FIG. 6C shows the second auxiliary grid Gs2 having three circular electron beam passage holes 24 so arranged horizontally in line as to correspond to the three cathodes K. That surface of the first segment electrode G31 of third grid G3, which faces the second auxiliary grid Gs2, that surface of the second segment electrode G32, which faces the fourth grid G4, and that surface of the fourth grid G4, which faces the second segment electrode G32, are each provided with three circular electron beam passage holes which are so arranged horizontally in line as to correspond to the three cathodes K and are greater than the electron beam passage holes 24 in the second auxiliary grid Gs2. On the other hand, that surface of the second segment electrode G31 of third grid G3, which faces the first segment electrode G31, is provided with three non-circular electron beam passage holes which are so arranged horizontally in line as to correspond to the three cathodes K and each have a horizontal dimension greater than a vertical dimension.

In addition, in this embodiment, the diameter $\phi$G2 of the electron beam passage hole 22 in the second grid G2, the horizontal dimension $\phi$Gs1H and vertical dimension $\phi$Gs1V of the hole in first auxiliary grid Gs1, and the diameter $\phi$Gs2 of the hole in the second auxiliary grid Gs2 have the following relationship:

$$\phi G2 \leqq \phi Gs1H < \phi Gs2 \leqq \phi Gs1V$$

Figure 7A:
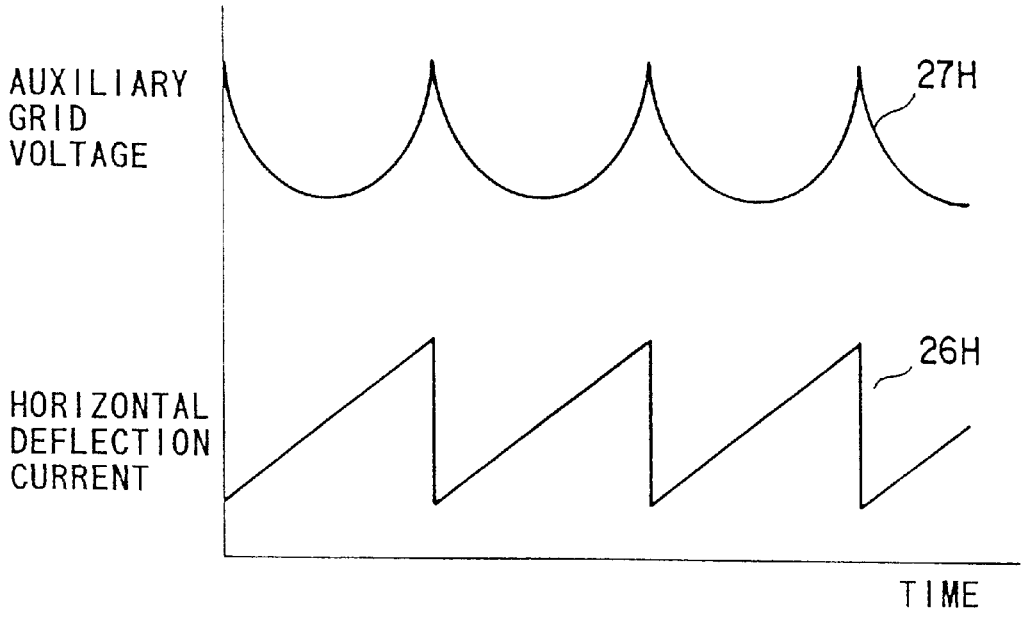
FIG. 7A is a graph showing a variation in a horizontal deflection current supplied to a deflection yoke for horizontally deflecting electron beams and a variation in a voltage applied to the first auxiliary grid shown in FIG. 5 in synchronism with horizontal deflection of electron beams.
Figure 7B:
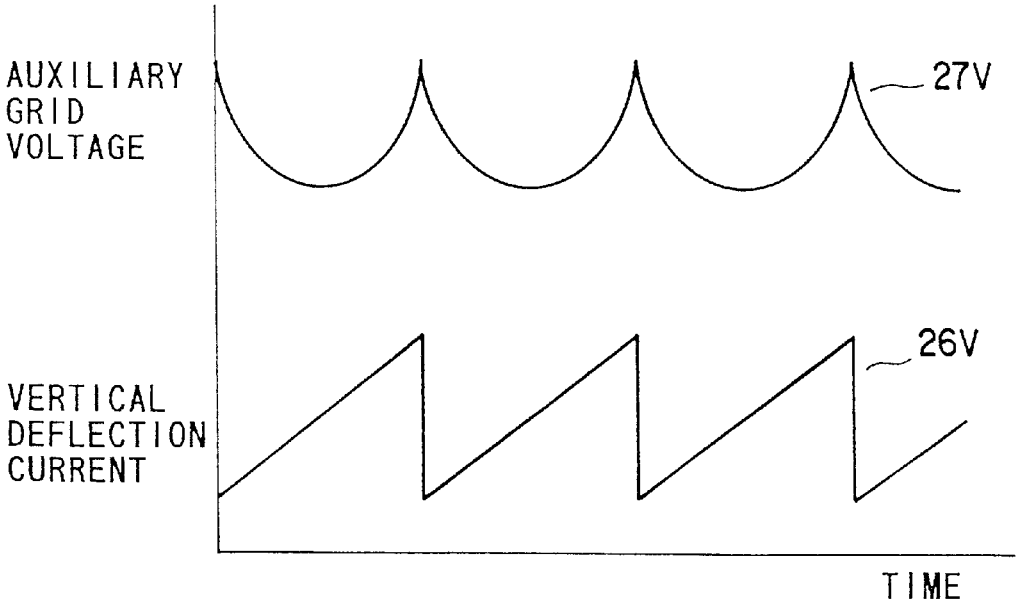
FIG. 7B is a graph showing a variation in a vertical deflection current supplied to a deflection yoke for vertically deflecting electron beams and a variation in a voltage applied to the first auxiliary grid shown in synchronism with the vertical deflection.

In this electron gun assembly 17, a voltage of about 150V is applied to each cathode K, and the first grid G1 is grounded. A voltage of about 600V to 800V is applied to the second grid G2. The first auxiliary grid Gs1 is supplied with voltages increasing in synchronism with deflection of electron beams, as described below, i.e. dynamic voltages 27H and 27V obtained by superimposing voltages, which increase in synchronism with horizontal and vertical deflection currents 26H and 26V, on a reference voltage substantially equal to the voltage of the second grid, as shown in FIGS. 7A and 7B. The second auxiliary grid Gs2 is connected to the second grid G2 in the tube, and a voltage of about 600V to 800V equal to the voltage to the second grid G2 is applied to the second auxiliary grid Gs2. A voltage of about 6 kV is applied to the first segment electrode G31 of third grid G3. The second segment electrode G32 is supplied with a dynamic voltage obtained by superimposing a voltage, which increases in synchronism with deflection of electron beams, on a reference voltage equal to the voltage applied to the first segment electrode G31. A voltage of about 26 kV is applied to the fourth grid G4.

With the application of such voltages in the electron gun assembly 17, the cathodes K and first and second grids G1 and G2 produce electron beams and constitute a triple-pole unit for forming an object point on the main lens, as will be described later. The second grid G2, the first and second auxiliary grids Gs1 and Gs2 and the first segment electrode G31 of third grid G3 constitute a prefocus lens for preliminarily focusing electron beams from the triple-pole unit. The first and second segment electrodes G31 and G32 of third grid G3 and the fourth grid G4 constitute a bi-potential (BPF) type main lens for finally focusing the electron beams, which have preliminarily been focused by the prefocus lens, onto the phosphor screen.

If the voltages to the first and second auxiliary grids Gs1 and Gs2 are set, as described above, the second auxiliary grid Gs2, to which the voltage equal to that to the second grid G2 is applied, provides a shield against the magnetic field of the third grid G3. Thereby, excessive incoming of potential from the third grid G3 is suppressed. Thus, the second grid G2, first and second auxiliary grids Gs1 and Gs2 can be set at substantially equal potential levels, and as a result no electron lens forms between these electrodes. On the other hand, since the second auxiliary grid Gs2 has the circular electron beam passage holes 24, a rotation-symmetric lens with no astigmatism is formed between the second auxiliary Gs2 and third grid G3.

As a result, there is provided an electron gun assembly wherein the prefocus lens formed by the second grid G2, first and second auxiliary grids Gs1 and Gs2 and the first segment electrode G31 of third grid G3 has no astigmatism. The horizontal and vertical dimensions of the imaginary object point on the main lens can be equalized.

The electron beams prefocused by the prefocus lens are then focused by the main lens to reach the center of the screen. In this case, an equal voltage is applied to the first and second segment electrodes G31 and G32 of the third grid G3, and no electron lens is formed between the segment electrodes G31 and G32. The electron beams are focused by the lens formed between the second segment electrode G32 and the fourth grid G4 and accordingly a circular beam spot is formed on the phosphor screen.

In order to obtain a desired divergence angle and a desired imaginary object point of electron beams at the prefocus lens in a case where the electron beams are not deflected, the relationship between the diameter $\phi G2$ of the electron beam passage hole 22 in the second grid G2 and the diameter $\phi Gs2$ of the electron beam passage hole 24 in the second auxiliary grid Gs2 may be set as follows:

$$\phi G2<\phi Gs2$$

Figure 8:
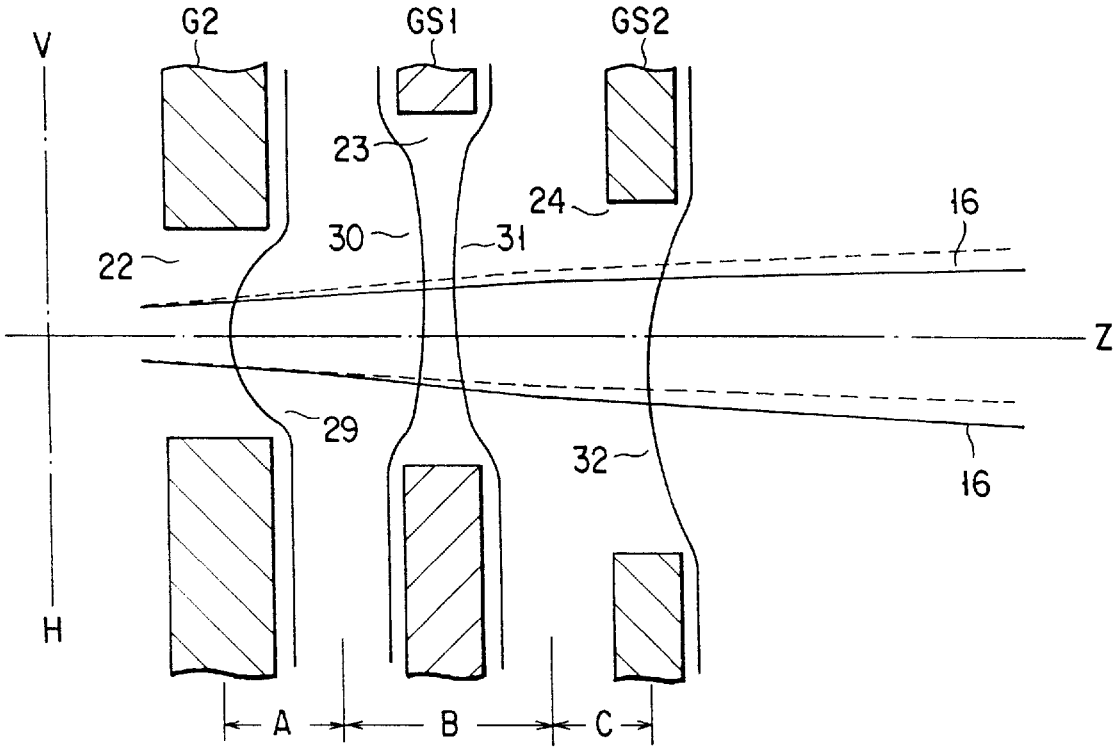
FIG. 8 is a schematic cross-sectional view for describing the operation of a prefocus lens formed by the second grid, the first and second auxiliary grids, and the first segment electrode of the third grid in the electron gun assembly shown in FIG. 5.

In a case where the electron beams are deflected toward the periphery of the screen, a higher voltage is applied to the first auxiliary grid Gs1 than in the case where the electron beams are not deflected. In this case, the prefocus lens formed by the second grid G2, first and second auxiliary grids Gs1 and Gs2 and first segment electrode G31 of third grid G3 performs a lens operation, as illustrated in FIG. 8. In FIG. 8, an upper side of the tube axis (Z-axis) indicates an electric field distribution 29 in a vertical direction, i.e. in a vertical plane (a plane defined by H-axis and Z-axis), and a lower side of the tube axis indicates an electric field distribution 29 in a horizontal direction, i.e. in a horizontal plane. FIG. 8 also shows trajectories of electron beams. As is shown in FIG. 8, if the voltage of the first auxiliary grid Gs1 is increased, the electric field 29 enters the electron beam passage hole 22 in the second grid G2. In a region A between the second grid G2 and a midpoint between the second grid G2 and first auxiliary grid Gs1, electron beams 16 (16B, 16G, 16R) are influenced by a focusing operation in both horizontal and vertical directions. This focusing operation becomes stronger as the voltage of the first auxiliary grid Gs1 increases.

On the other hand, in a region B between a midpoint, which lies between the second grid G2 and first auxiliary grid Gs1, and a midpoint, which lies between the first auxiliary grid Gs1 and second auxiliary grid Gs2, electric fields 30 and 31 enter the electron beam passage hole 23 in the first auxiliary grid Gs1 from the second grid (G2) side and the second auxiliary grid (Gs2) side. The electron beam 16 is thus diverged. In this case, since the vertical dimension $\phi Gs1V$ of the electron beam passage hole 23 in the first auxiliary grid Gs1 is greater than the horizontal direction $\phi Gs1H$ thereof, a strong divergence effect acts on the beam in the horizontal direction, but a divergence effect acting on the beam in the vertical direction is weak. Moreover, the divergence effect increases as the voltage to the first auxiliary grid Gs1 increases.

In a region C extending from a midpoint, which lies between the first auxiliary grid Gs1 and second auxiliary grid Gs2, to the second auxiliary grid Gs2, an electric field 32 enters the electron beam passage hole 24 in the second auxiliary grid Gs2 from the third grid (G3) side. The electron beam 16 is thus converged in the horizontal and vertical directions. This convergence effect is substantially invariable even if the voltage to the first auxiliary grid Gs1 varies.

In order to obtain a sufficient horizontal divergence effect and a sufficient vertical convergence effect when the electron beam is deflected, the following relationships should preferably be established among the horizontal and vertical diameters $\phi Gs1H$ and $\phi Gs1V$ of the electron beam passage hole 23 in the first auxiliary grid Gs1, the diameter $\phi G2$ of the electron beam passage hole 22 in the second grid G2 and the diameter $\phi Gs2$ of the electron beam passage hole 24 in the second auxiliary grid Gs2:

$$\phi G2 \leqq \phi Gs1H<\phi Gs2$$

$$\phi Gs2 \leqq \phi Gs1V$$

Accordingly, $$\phi G2 \leqq \phi Gs1H<\phi Gs2 \leqq \phi Gs1V$$

In brief, where the electron beam is deflected, compared to the case where the electron beam is not defected, the prefocus lens, which is formed by the second grid G2, the first and second auxiliary grids Gs1 and Gs2 and the first segment electrode G31 of third grid G3, is altered to reduce the horizontal convergence effect and to increase the vertical convergence effect, and a negative astigmatism thereof increases. Thus, compared to the case where the electron beam is not deflected, the electron beam is altered by the negative astigmatism of the prefocus lens such that the horizontal dimension of the imaginary object point decreases and the vertical dimension thereof increases. In addition, compared to the case where the electron beam is not deflected, the divergence angle of the electron beam increases in the horizontal direction and decreases in the vertical direction.

The electron beam prefocused by the prefocus lens, as described above, is finally focused on the phosphor screen by the main lens formed by the first and second segment electrodes G31 and G32 of third grid G3 and the fourth grid G4.

Specifically, where the electron beam is deflected, a voltage increasing in synchronism with the deflection of the electron beam is applied to the second segment electrode G32 of third grid G3. Thus, compared to the case where the electron beam is not deflected, the power of the lens formed by the second segment electrode G32 and fourth grid G4 decreases and an increasing portion of the trajectory of the electron beam incident on the peripheral portion of the screen is corrected. At the same time, the four-pole lens having a positive astigmatism is formed between the first and second segment electrodes G31 and G32, and a change in the divergence angle of the electron beam due to a deflection aberration and a negative astigmatism caused by the prefocus lens is corrected.

As a result, the electron beams 16B, 16G and 16R converged by the main lens and guided to the peripheral portion of the screen is exactly focused on the phosphor screen in the horizontal and vertical directions. In addition, since the horizontal dimension of the imaginary object point is decreased by the negative astigmatism caused by the prefocus lens, the horizontal dimension of the beam spot on the phosphor screen 12 decreases. Furthermore, since the vertical dimension of the imaginary object point is increased, the vertical dimension of the beam spot on the peripheral portion of the screen increases. Thereby, the elliptic distortion of the beam spot on the peripheral portion of the screen can be reduced.

Figure 9:
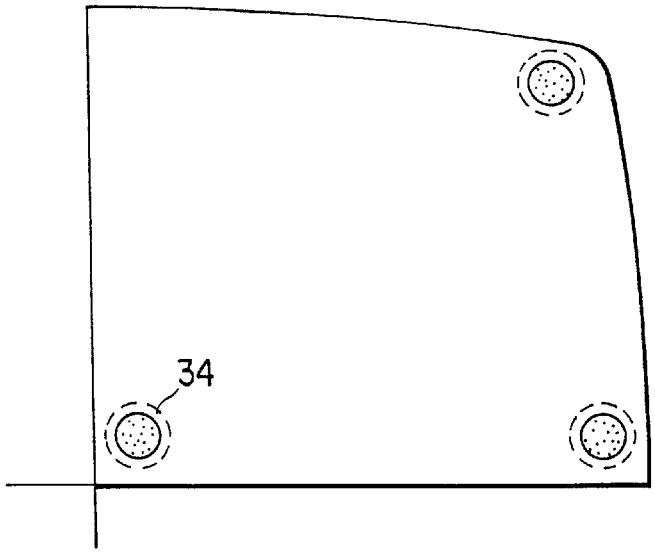
FIG. 9 is a schematic plan view for describing the shape of beam spots formed on the screen of the in-line type color CRT according to the embodiment of the invention.

If the electron gun assembly 17 is constructed as described above, the shape of the beam spot 34 can be made substantially circular over the entire region of the screen, as shown in FIG. 9. Therefore, a color CRT apparatus can be provided, wherein the focusing over the entire region of the screen is made uniform and high-quality images can be displayed.

Figure 1:
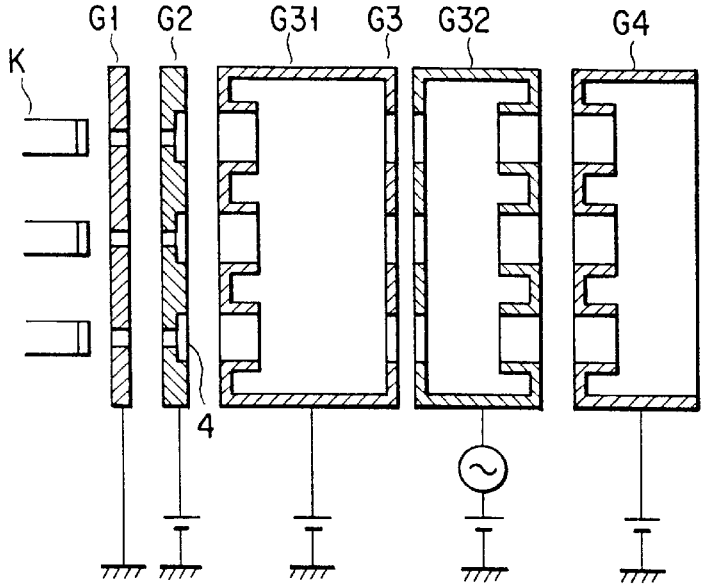
FIG. 1 is a cross-sectional view schematically showing the structure of a conventional electron gun assembly for an in-line type color cathode ray tube (CRT)
Figure 2A:
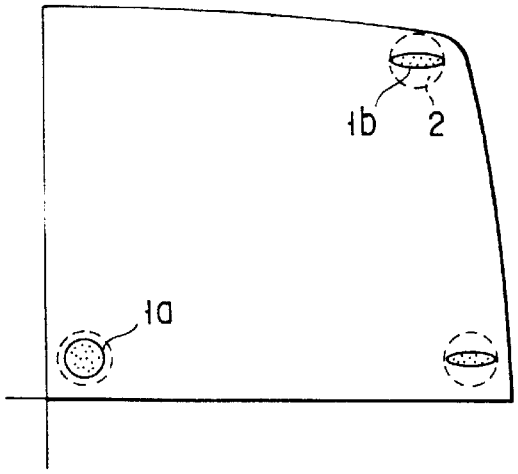
FIG. 2A is a plan view for describing the shape of a beam spot formed on a screen of an in-line type color CRT having the conventional electron gun assembly.
Figure 2B:
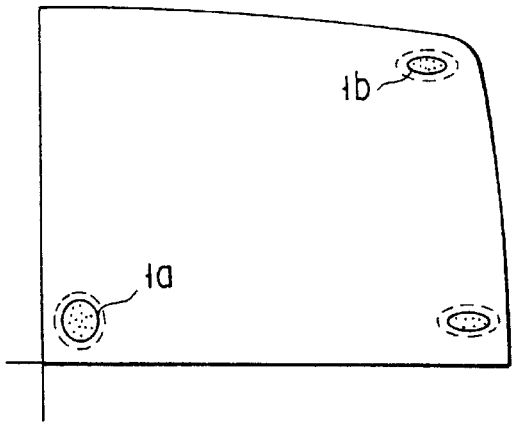
FIG. 2B is a plan view for describing the shape of a beam spot formed on a screen of a color CRT having a conventional BPF-type DACF-system electron gun assembly.
Figure 2C:
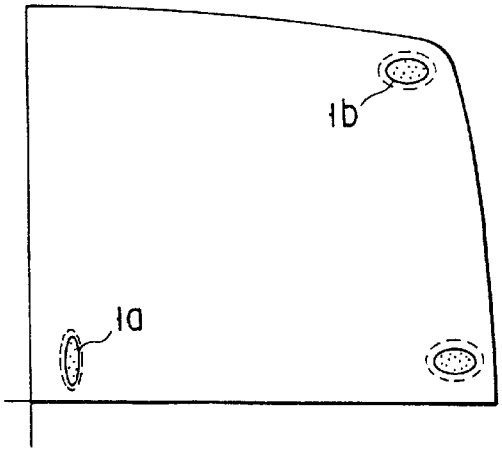
FIG. 2C is a plan view for describing the shape of a beam spot formed on a screen of a color CRT having an electron gun assembly constructed by modifying the BPF-type DACF-system electron gun assembly shown in FIG. 2B such that the second grid is provided with three non-circular recesses each having a horizontal long axis.
Figure 3:
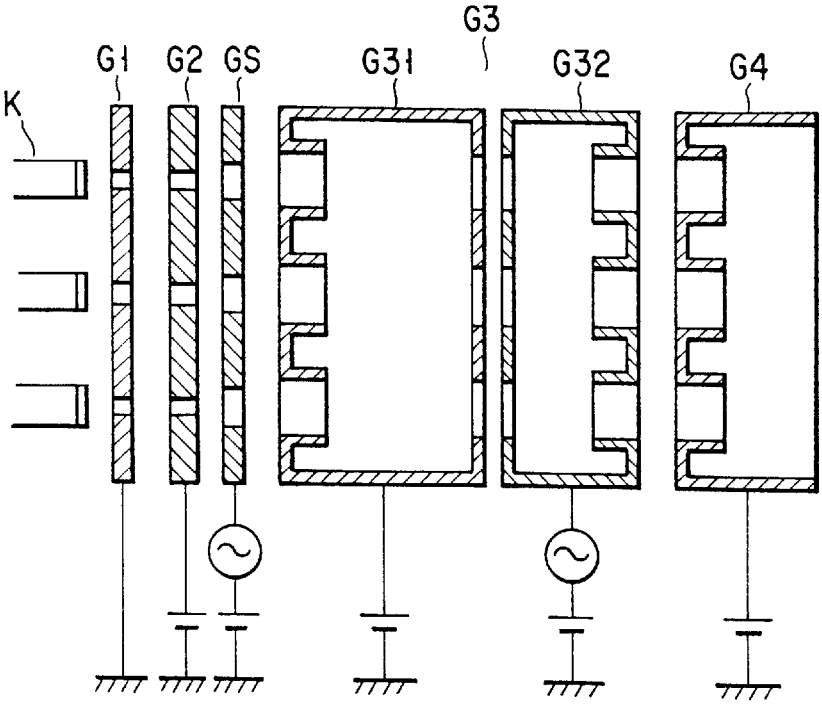
FIG. 3 is a cross-sectional view schematically showing the structure of an electron gun assembly for a conventional in-line type color CRT, wherein an auxiliary grid is disposed between the second grid and the first segment electrode of the third grid shown in FIG. 1.

The above description is directed to the case where the shape of each of the three electron beam passage holes in the second grid is circular. However, like the second grid shown in FIG. 1, that surface of the second grid, which faces the first auxiliary grid, may be provided with, independently of the three electron beam passage holes, a non-circular recess having a long axis in the direction of the three electron beam passage holes (i.e. in the direction of arrangement of the three electron beams) or a groove which commonly crosses the three electron beam passage holes and is elongated in the direction of arrangement of the three electron beams.

If the second grid is constructed as described above, the horizontal and vertical divergence angles of the electron beams can be well balanced and the shape of the beam spot 34 can easily be made circular over the entire region of the screen. Therefore, a color CRT apparatus can be provided, wherein the focusing over the entire region of the screen is made uniform and high-quality images can be displayed.

In the above embodiment, the shape of each of the electron beam passage holes in the second auxiliary grid is made circular. However, the shape of each of the electron beam passage holes in the second auxiliary grid may be made non-circular.

If the shape of each of the electron beam passage holes in the second auxiliary grid is made non-circular, the horizontal and vertical divergence angles of the electron beams can be well balanced and the shape of the beam spot 34 can easily be made circular over the entire region of the screen. Therefore, a color CRT apparatus can be provided, wherein the focusing over the entire region of the screen is made uniform and high-quality images can be displayed.

In the electron gun assembly as described above, the first auxiliary grid, to which a dynamic voltage increasing in synchronism with the deflection of electron beams, and the second auxiliary grid, to which a fixed voltage is applied, are arranged in the named order on the phosphor screen side of the second grid. The second grid, the first and second auxiliary grids, and the grid located on the phosphor screen side of the second auxiliary grid constitute the electron lens having such an astigmatism that the vertical focusing power is higher than the horizontal focusing power and the degree of astigmatism varies dynamically in accordance with the dynamic voltage applied to the first auxiliary grid. Thereby, the imaginary object point size can be dynamically altered by a relatively low dynamic voltage, and the elliptic distortion of the beam spot on the peripheral portion of the screen can be reduced. Therefore, a color CRT apparatus can be provided, wherein the focusing over the entire region of the screen is made uniform and high-quality images can be displayed, while the cost for the driver circuit is reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube apparatus comprising:

a vacuum envelope having a phosphor screen;

an electron gun assembly for generating three electron beams toward the phosphor screen, the electron gun assembly including, cathodes for generating three in-line electron beams traveling in a single plane and constituting a triple-pole unit, first and second grids disposed between the cathodes and the phosphor screen, a third grid disposed adjacent to the second grid, the third grid forming a lens for focusing the electron beams from the triple-pole unit onto the phosphor screen, and first and second auxiliary grids disposed between the second grid and the third grid;

voltage application means for applying a dynamic voltage, which varies in synchronism with deflection of the electron beams, to the first auxiliary grid, and for applying a fixed voltage to the second auxiliary grid, said second grid, said first and second auxiliary grids and said third grid forming an electron lens such that a higher astigmatism is provided by focusing in a direction perpendicular to a direction of arrangement of the three electron beams than by focusing in the direction of arrangement of the three electron beams and the degree of the astigmatism is dynamically varied in accordance with the dynamic voltage applied to the first auxiliary grid; and a deflection yoke for generating non-uniform horizontal and vertical deflection magnetic fields for deflecting the three electron beams guided onto the phosphor screen, the electron beams being self-converged by the deflection with the non-uniform horizontal and vertical deflection magnetic fields.

2. A color cathode ray tube apparatus according to claim 1, wherein said application means applies to the first auxiliary grid a dynamic voltage obtained by superimposing a voltage increasing in synchronism with the deflection of the electron beams to a voltage substantially equal to a voltage applied to the second grid.

3. A color cathode ray tube apparatus according to claim 1, wherein said application means applies to the second auxiliary grid a voltage equal to a voltage applied to the second grid.

4. A color cathode ray tube apparatus according to claim 1, wherein said first auxiliary grid has electron beam passage holes for passage of the three electron beams, each of the electron beam passage holes being formed non-circular such that a dimension thereof in a direction perpendicular to a direction of arrangement of the three electron beams is greater than a dimension thereof in the direction of arrangement of the three electron beams.

5. A color cathode ray tube apparatus according to claim 1, wherein said second auxiliary grid has circular electron beam passage holes for passage of the three electron beams.

6. A color cathode ray tube apparatus according to claim 1, wherein said second auxiliary grid has electron beam passage holes for passage of the three electron beams, each of the electron beam passage holes being formed non-circular such that a dimension thereof in a direction perpendicular to a direction of arrangement of the three electron beams is different from a dimension thereof in the direction of arrangement of the three electron beams.

7. A color cathode ray tube apparatus according to claim 1, wherein said second grid has electron beam passage holes for passage of the three electron beams, and each of non-circular recesses each having a major axis in a direction of arrangement of the three electron beams or grooves each elongated in the direction of arrangement of the three electron beams is formed at a surrounding region of each of the electron beam passage holes at that surface of the second grid, which faces the first auxiliary grid.

8. A color cathode ray tube apparatus according to claim 1, wherein said second grid has circular holes for passage of the three electron beams, said first auxiliary grid has holes for passage of the electron beams, each of which holes is formed non-circular such that a dimension thereof in a direction perpendicular to a direction of arrangement of the three electron beams is greater than a dimension thereof in the direction of arrangement of the three electron beams, and said second auxiliary grid has circular holes for passage of the electron beams, and wherein when a diameter of each of the holes in the second grid is $\phi G2$, a dimension of each of the holes in the first auxiliary grid in the direction perpendicular to the direction of arrangement of the three electron beams is $\phi Gs1V$, a dimension of each of the holes in the first auxiliary grid in the direction of arrangement of the three electron beams is $\phi Gs1H$, and a diameter of each of the holes in the second auxiliary grid is $\phi Gs2$, the following relationship is established:

$$\phi G2 \leqq \phi Gs1H < \phi Gs2 \leqq \phi Gs1V.$$

9. A color cathode ray tube apparatus according to claim 1, wherein said third grid is divided into first and second electrodes, and the application means applies a dynamic voltage varying in synchronism with deflection of the electron beams to the second electrode disposed apart from the second auxiliary grid.

* * * * *